US008621694B2

(12) United States Patent
Farley

(10) Patent No.: US 8,621,694 B2
(45) Date of Patent: Jan. 7, 2014

(54) SLEEP SUPPORT SURFACE THAT INCLUDES A LAYER WITH LARGE DIAMETER CLEAVING

(75) Inventor: David Farley, Corona, CA (US)

(73) Assignee: FXI, Inc., Media, PA (US)

( * ) Notice: Subject to any disclaimer, the term of this patent is extended or adjusted under 35 U.S.C. 154(b) by 149 days.

(21) Appl. No.: 12/879,973

(22) Filed: Sep. 10, 2010

(65) Prior Publication Data

US 2011/0061168 A1 Mar. 17, 2011

Related U.S. Application Data

(60) Provisional application No. 61/241,888, filed on Sep. 12, 2009.

(51) Int. Cl.
*A47C 17/00* (2006.01)

(52) U.S. Cl.
USPC ..... 5/730; 5/729; 5/728; 5/727; 5/718; 5/740

(58) Field of Classification Search
USPC ..... 5/730, 729, 728, 727, 718, 740
See application file for complete search history.

(56) References Cited

U.S. PATENT DOCUMENTS

| | | | | | |
|---|---|---|---|---|---|
| 2,192,601 | A * | 3/1940 | Mattison | 5/729 |
| 4,194,255 | A * | 3/1980 | Poppe | 267/153 |
| 4,233,700 | A | 11/1980 | Spann | |
| 4,638,517 | A * | 1/1987 | Yang et al. | 5/236.1 |
| 4,777,855 | A | 10/1988 | Cohen | |
| 4,999,868 | A * | 3/1991 | Kraft | 5/730 |
| 5,025,519 | A * | 6/1991 | Spann et al. | 5/730 |
| 5,477,573 | A | 12/1995 | Bonaddio et al. | |
| 5,491,852 | A * | 2/1996 | Maucher | 5/730 |
| 6,003,179 | A * | 12/1999 | Farley | 5/736 |
| 6,041,459 | A * | 3/2000 | Nunez et al. | 5/730 |
| RE38,135 | E * | 6/2003 | Stolpmann et al. | 5/740 |
| 6,658,683 | B2 * | 12/2003 | Parvin | 5/727 |
| 6,668,404 | B2 | 12/2003 | Lanteri | |
| 6,701,557 | B2 * | 3/2004 | Barman | 5/730 |
| 6,704,961 | B2 * | 3/2004 | Kienlein | 5/730 |
| 6,782,575 | B1 * | 8/2004 | Robinson | 5/740 |
| 6,941,603 | B2 | 9/2005 | Radice | |
| 7,036,173 | B2 | 5/2006 | Gladney | |
| 7,293,311 | B2 | 11/2007 | Baker | |
| 7,496,981 | B2 * | 3/2009 | Alonso Cucurull | 5/740 |
| 7,507,468 | B2 | 3/2009 | Landvik et al. | |
| 7,571,504 | B2 * | 8/2009 | Kuo | 5/724 |
| 7,661,165 | B2 * | 2/2010 | Piccinini et al. | 5/720 |
| 7,886,388 | B2 * | 2/2011 | Warren et al. | 5/740 |
| 2004/0033351 | A1 * | 2/2004 | Landvik et al. | 428/316.6 |
| 2005/0044635 | A1 * | 3/2005 | O'Reagan | 5/736 |
| 2005/0115003 | A1 * | 6/2005 | Torbet et al. | 5/727 |
| 2009/0222996 | A1 * | 9/2009 | Balonick et al. | 5/730 |

* cited by examiner

*Primary Examiner* — Robert G Santos
*Assistant Examiner* — David E Sosnowski
(74) *Attorney, Agent, or Firm* — Novak Druce Connolly Bove + Quigg LLP

(57) ABSTRACT

A layered mattress including a first layer having a first support surface facing substantially externally and a second support surface opposite the first support surface; a specialized layer having a top support surface adjacent the second support surface of the first layer, a bottom support surface, and a plurality of holes defined to extend through the specialized layer; a second layer having a third support surface adjacent the bottom support surface of the specialized layer and a fourth support surface opposite the third support surface; and a pad having a fifth support surface adjacent the fourth support surface of the second layer and a sixth support surface opposite the fifth support surface.

13 Claims, 3 Drawing Sheets

SLEEP SUPPORT SURFACE THAT INCLUDES A LAYER WITH LARGE DIAMETER CLEAVING

This application claims the benefit and priority of U.S. Provisional Application No. 61/241,888, filed on Sep. 12, 2009, which is herein incorporated by reference in its entirety for all purposes.

BACKGROUND

1. Field

This disclosure is related to mattresses and particularly flexible foam mattresses having support surfaces that include at least one layer with large diameter cleaved channels or holes producing enhanced elongatability and elastic performance in the lateral (horizontal) direction.

2. Related Art

Typically, flexible foam mattresses achieve anatomical support primarily by way of progressively layering foam layers of various degrees of softness and by creating defined support areas through the use of construction layers that have been shaped and contoured by way of the surface specific location, extraction or shaping of the foam to create differing load bearing regions of support. Such products usually create a number of anatomic support regions (or zones) to accommodate the neck, shoulders, lumbar, hips and thigh. Such products also typically are designed with such other zones below the thigh to mimic the neck, shoulder and lumbar support when these products are rotated in orientation from head to toe.

SUMMARY

The present disclosure provides a mattress having anatomical support, such as lumbar support, achieved through the use of a specialized support layer including large diameter, through and through, cloven holes or channels. The cloven holes increase the elongatability and the elastic performance of the specialized foam layer, causing the specialized foam layer to essentially creep laterally when placed under compression, mimicking the performance of fluid while accommodating the human form in a more compliant manor.

This sleep support method produces enhanced anatomic performance unconventionally. The foam construction layer includes large diameter holes or channels (over ½" diameter) across all or most of its surface. In one aspect the holes do not come within 4 inches of the perimeter of the layer to allow perimeter only fastening which also enhances the lateral creep of the layer and the fluid like performance of the sleep support surface.

In one aspect, a layered mattress is provided including a first layer having a first support surface facing substantially externally and a second support surface opposite the first support surface; a specialized layer having a top support surface adjacent the second support surface of the first layer, a bottom support surface, and a plurality of holes defined to extend through the specialized layer and include openings on the top and bottom support surfaces; a second layer having a third support surface adjacent the bottom support surface of the specialized layer and a fourth support surface opposite the third support surface; and a pad having a fifth support surface adjacent the fourth support surface of the second layer and a sixth support surface opposite the fifth support surface.

In another aspect, a layered mattress is provided including a first layer having a first support surface facing substantially externally and a second support surface opposite the first support surface; a specialized layer having a top support surface adjacent the second support surface of the first layer, a bottom support surface, and a plurality of holes defined to extend through the specialized layer and include openings on the top and bottom support surfaces, the holes including a constant circular cross section having a diameter of at least ⅝ inch; a second layer having a third support surface adjacent the bottom support surface of the specialized layer and a fourth support surface opposite the third support surface, at least a portion of the second support surface is adhered to at least a portion of the top support surface of the specialized layer, and at least a portion of the third support surface is adhered to at least a portion of the bottom support surface of the specialized layer; and a pad having a fifth support surface adjacent the fourth support surface of the second layer and a sixth support surface opposite the fifth support surface.

A more complete understanding of the invention can be obtained by reference to the following detailed description of the embodiments thereof in connection with the attached drawings.

BRIEF DESCRIPTION OF THE DRAWINGS

The above and other objects, features and advantages of the present invention will become more apparent from the following detailed description when taken in conjunction with the accompanying drawings in which.

DETAILED DESCRIPTION

Figure 1:
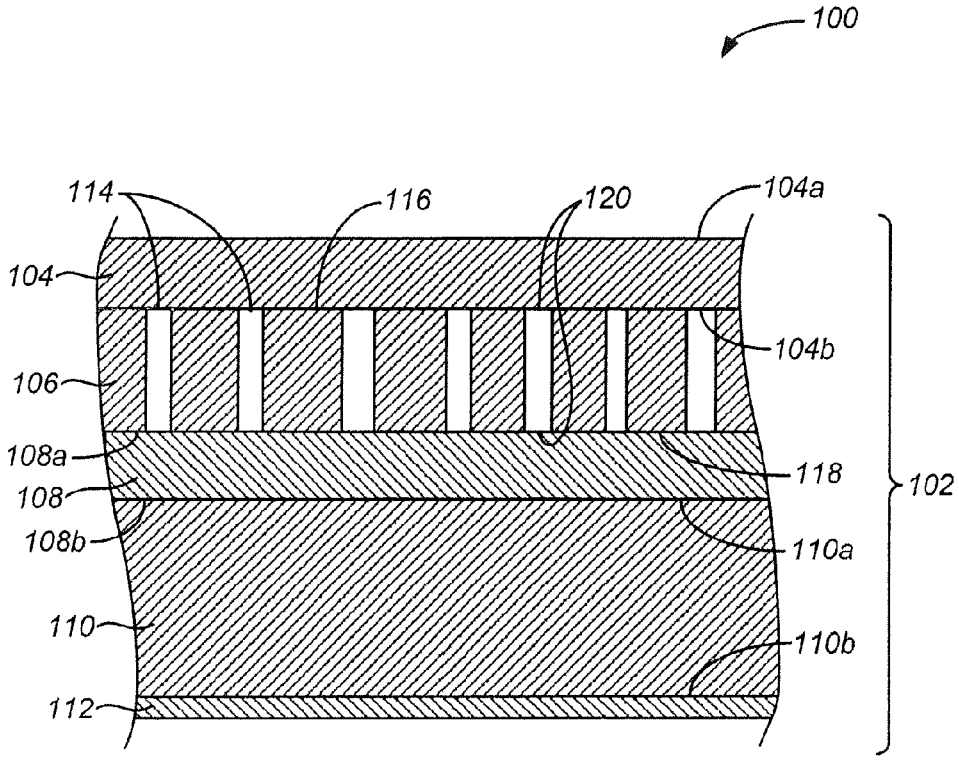
FIG. 1 is a simplified cross sectional view of a flexible support mattress having support layers in accordance with an embodiment.

FIG. 1 is a cross-sectional view of a mattress 100 including a plurality of layers 102 in accordance with an embodiment. The mattress 100 has length and width dimensions sufficient to support a reclining body of an adult. In one embodiment, the layers 102 include a first or surface layer 104, a specialized layer 106, a second layer 108, a pad 110 and a third layer 112. The layers 102 may be covered and held together using an outer covering (not shown). For example, the covering may include a removable outer fabric cover. It should be understood that the specialized layer 106 may be used with some, all or any combination of these layers while not departing from the scope of the invention. It should also be understood that the total number of layers 102 may vary between implementations, including the use of more than one specialized layer 106 while not departing from the scope of the invention.

The first layer 104 includes a generally planar first support surface 104*a* adapted to substantially face externally, and a generally planar second support surface 104*b* opposite the first support surface. In one embodiment, the first layer 104 includes a substantially uniform thickness of about 1 inch to about 3 inches. In one embodiment, the first layer 104 may be a rigid or flexible, natural, polyurethane, or visco-elastic foam bedding materials that are available from a variety of sources, and which are well known in the art, such as an open surface foam or comfort flex foam. In one example, with no intent to be limiting, the first layer 104 may have a density in the range of between about 2 to about 8 lbs/ft$^2$. In one example, the indentation load deflection (ILD), the force required to indent the foam 25%, may range from between about 6 to about 20 lbs.

The second layer 108 includes a generally planar third support surface 108*a*, and a generally planar fourth support surface 108*b* opposite the third support surface. In one embodiment, the second layer 108 includes a substantially uniform thickness of about 1 inch to about 3 inches. In one embodiment, the second layer 108 may also be rigid or flexible, natural, polyurethane or visco-elastic foam bedding materials. These bedding materials, such as memory foam or transition foam, are well known in the art and are available from a variety of sources. In one example, with no intent to be limiting, the second layer 108 may have a density in the range of between about 2 to about 4 lbs/ft$^2$. In one example, the ILD may range from between about 15 to about 20 lbs.

The pad 110 includes a generally planar fifth support surface 110*a*, and a generally planar sixth support surface 110*b* opposite the fifth support surface. In one embodiment, the pad 110 includes a substantially uniform thickness of between about 1 inch to about 7 inches. In one embodiment, the pad 110 may be made of support core foam, which is well known in the art. In one example, with no intent to be limiting, the pad 110 may have a density in the range of between about 1 to about 2 lbs/ft$^2$. In one example, the ILD may range from between about 30 to about 60 lbs.

In one embodiment, the specialized layer 106 may be made of a cellular material, such as polyurethane foam, a visco-elastic foam and the like. In one embodiment, the specialized layer 106 includes a substantially uniform thickness of between about 1 inch to about 5 inches. In one embodiment, the specialized layer 106 may be made of elastic foam or anatomic support foam, which are well known in the art. In one example, with no intent to be limiting, the specialized layer 106 may have a density in the range of between about 2 to about 8 lbs/ft$^2$. In one example, the ILD may range from between about 6 to about 20 lbs.

As shown in FIG. 1, the specialized layer 106 includes a plurality of holes or channels 114 defined to extend vertically through the specialized layer 106 from a top surface 116 to a bottom surface 118 of the specialized layer. In fabricating the specialized layer 106, the holes 114 are cleaved or cut into the layer using a well-known type of foam cleaving technique. The cloven holes 114 are made completely through the entire thickness of the specialized layer 106. Openings 120 at each end of the holes 114 are defined on the top and bottom surfaces 116 and 118, since the holes extend completely through the specialized layer 106.

As shown in FIG. 1, in one embodiment, the holes 114 may be evenly and symmetrically distributed on the specialized layer 106. In alternative embodiments, the holes 114 may be distributed in alternative layouts. The alternative layouts may include, for example, the clustering of the holes with varying dimension in certain areas of the mattress. By varying the diameter of holes 114 and/or their density of distribution, the mattress 100 may be made more flexible. The variableness of the size and distribution of the holes 114 provides for the mechanical characteristics of the mattress and its anatomic support performance.

To provide the desired anatomic performance of the mattress, it is important that the holes 114 cut into the specialized layer 106 be of a relatively large diameter. The inclusion of large diameter, through and through holes 114, formed through the specialized layer 106 provides a higher level of suppleness in the lateral or horizontal direction. The cloven holes 114 increase the elastic performance of the specialized foam layer 106 allowing the layer to creep laterally between the surface layer 104 and the second layer 108 when placed under compression. The creep effect mimics the performance of a fluid causing the specialized layer 106 to bulge or swell in the areas under less compression to accommodate the human form in a more compliant manor. It has been found that holes 114 with diameters of ½ inch to ⅝ perform the functions of the mattress as described, however, ⅝ inch or larger diameter holes, produce the greatest swelling or bulging effect.

Once the first support layer 104, the specialized layer 106, the second support layer 108 and the pad 110 have been stacked together, the stack may be combined on the third layer 112, which is, for example, a rigid base foam, such as a sheet of a reticulated filter polyurethane foam, a Rebond (Recycled Foam) Composite of scrap memory foam or the equivalent. The third layer 112 may include a uniform thickness of between about 1 inch and 3 inches.

Figure 4:
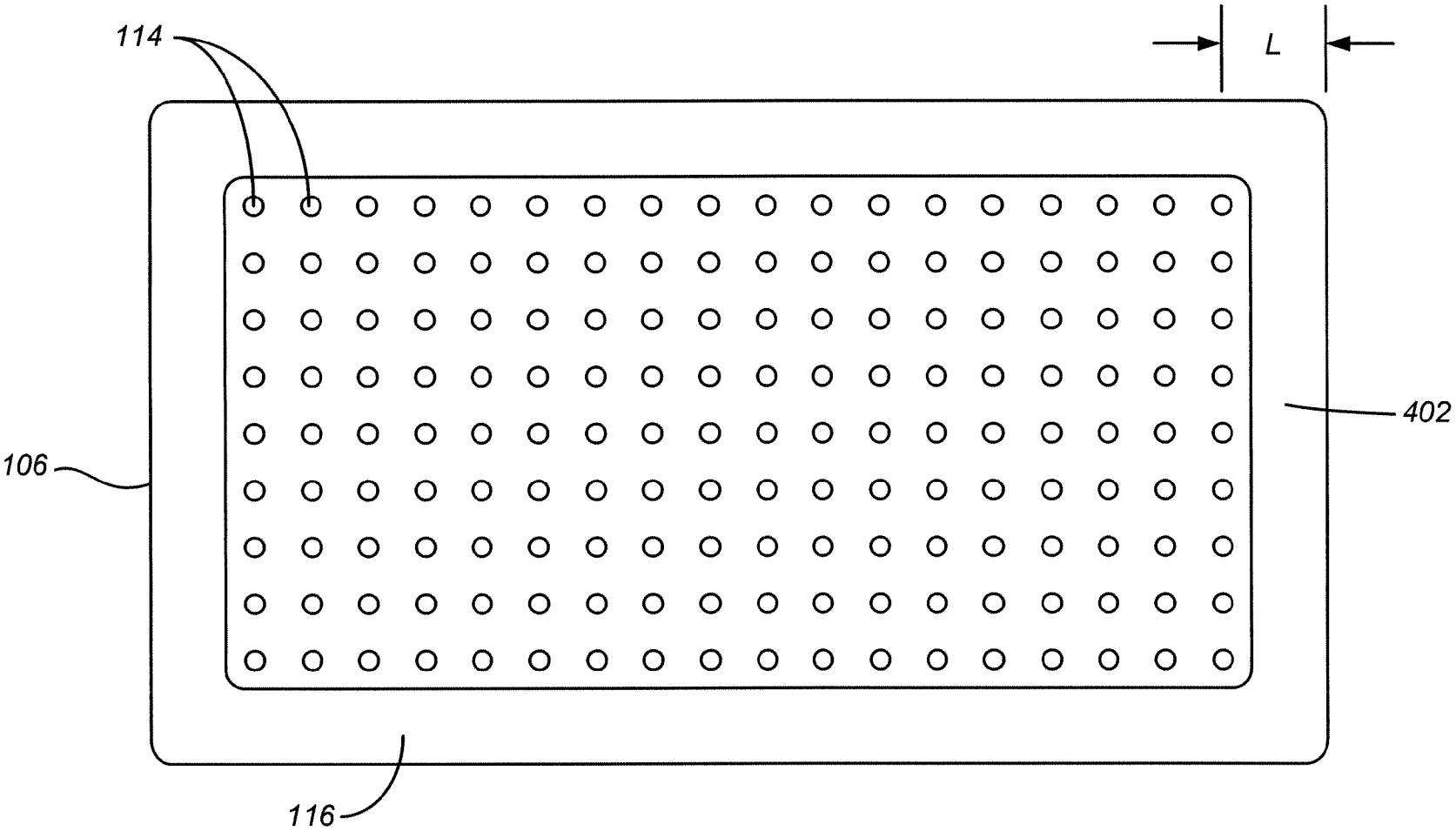
FIG. 4 is a simplified top view of a specialized layer in accordance with an embodiment.

In some embodiments, the layers 102 may or may not be adhered together. For example, the surface layer 104 may not be adhered to the specialized layer 106. Similarly, the second layer 108 may not be adhered to the specialized layer 106. In one embodiment, only a portion of the top and bottom surfaces 116 and 118 adjacent the perimeter of the specialized layer 106 may remain free of holes to allow perimeter only gluing of the specialized layer 106 to one or both of the surface layer 104 and the second layer 108. For example, as shown in FIG. 4, a gluing area 402 may be reserved adjacent the perimeter of the specialized layer 106 for gluing or the equivalent. The gluing area may have a dimension L, which may be between 3 and 5 inches wide, preferably 4 inches wide. In one embodiment, perimeter only gluing of the specialized layer 106 to the other layers enhances the lateral creep of the specialized layer 106 and thus, the fluid like performance of the specialized layer 106 is increased. In one embodiment, the layers may be adhered together using, for example, an adhesive as are well known in the industry.

Figure 3:
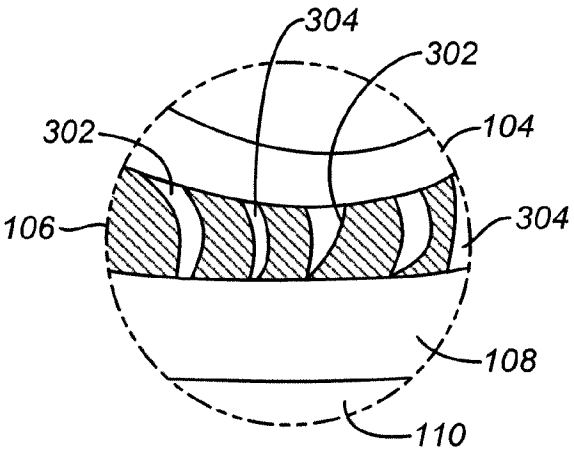
FIG. 3 is a magnified view of a portion of the flexible support mattress in accordance with an embodiment.
Figure 2:
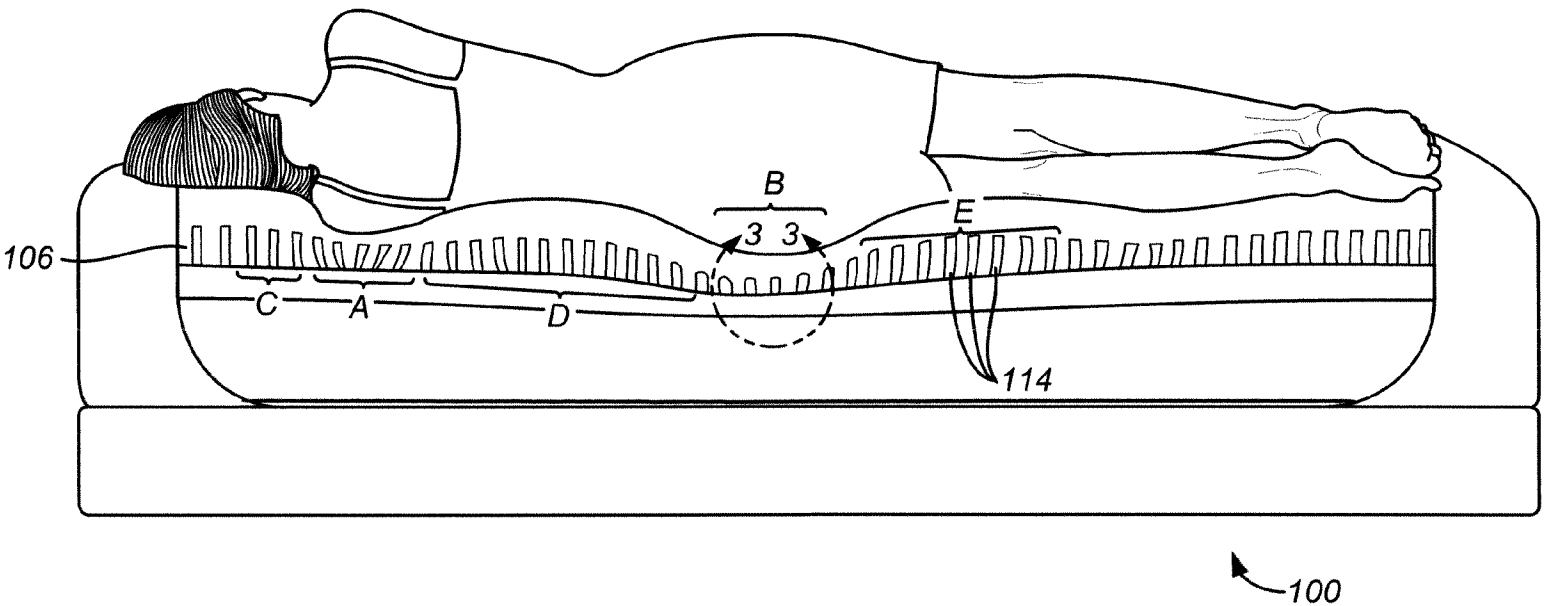
FIG. 2 is a side view of the flexible support mattress under compression from a human form thereon in accordance with an embodiment.

As shown in FIGS. 2 and 3, when placed under compression, such as by accommodating a human form, side walls 302 of the holes 114 collapse into a space or void 304 created by the holes 114. The increased diameter holes allow the material of the specialized layer 106 to move laterally into the hole space 304 to a degree that allows the specialized material to creep creating a bulge or swelling in areas under less compression.

This inclination toward lateral compression results due to the combined effects of the removal of a predetermined amount of material from within the holes 114, for example, the volume of a cylinder ⅝" diameter or greater; and the lateral collapse of the holes 114 into the hole space.

Thus, as shown in FIG. 2, the mattress 100 including specialized layer 106 with cleaved holes 114 functions to produce anatomic support without the need for shaping or other contouring of the mattress that is so common. For example, the area A under the shoulder and area B under the hip are generally under substantial compression in the areas immediately under these body protrusions. Under compression, the cloven holes 114 are of such a diameter that allows the side walls 302 to substantially buckle or collapse as described above. The foam material of the specialized layer 106 tends to creep laterally causing the mattress to bulge or swell in the areas C, D and E immediately adjacent the compressed areas A and B. Thus, in this example, the shoulder (area A) and hip (area B) receive soft vertical support while the neck (area C), the ribs (area D) and the upper thigh (area E) each receive enhanced anatomic support.

While the present invention has been shown and described with reference to specific embodiments thereof, it will be understood by those skilled in the art that various changes in form and details may be made therein without departing from the spirit and scope of the invention.

What is claimed is:

1. A layered mattress, comprising:

a first layer having a generally planar first support surface and a generally planar second support surface opposite the first support surface;

a second layer having a generally planar third support surface and a generally planar fourth support surface opposite the third support surface;

a specialized layer disposed between the first and second layers, the specialized layer having a top surface and a bottom surface opposite the top surface, said specialized layer defining a plurality of channels that fully extend through the specialized layer from the top surface to the bottom surface, wherein each of said channels is defined by at least one sidewall of material forming the specialized layer where the at least one sidewall surrounds an entire periphery of said channel, the plurality of channels being distributed substantially in a head supporting area, a neck supporting area, a shoulder supporting area, a hip supporting area, an upper thigh supporting area, and a leg supporting area along the top and bottom surfaces of the specialized layer such that the specialized layer is configured to support a full length of a reclining body, and wherein the head supporting area, the neck supporting area, the shoulder supporting area, the hip supporting area, the upper thigh supporting area, and the leg supporting area are contained within a perimeter area adjacent to the perimeter of the specialized layer; and a gluing area between three and five inches wide, the gluing area located adjacent the perimeter area, being devoid of channels, and surrounding the perimeter area of the specialized layer wherein the gluing area is configured to enhance lateral creep of the specialized layer, thereby increasing fluid like performance of the specialized layer.

2. The layered mattress of claim 1, wherein each channel includes a collapsible sidewall configured to collapse into a channel void.

3. The layered mattress of claim 1, wherein each channel has a circular cross-section.

4. The layered mattress of claim 1, wherein each channel has a cross-sectional diameter of at least ⅝ inch.

5. The layered mattress of claim 1, further comprising a pad disposed under the specialized layer, the pad having a generally planar fifth support surface and a generally planar sixth support surface opposite the fifth support surface.

6. The layered mattress of claim 1, wherein the perimeter area is glued to the first layer.

7. The layered mattress of claim 1, wherein the perimeter area is glued to the second layer.

8. The layered mattress of claim 1, wherein the perimeter area is glued to the first layer and the second layer.

9. A specialized layer for a mattress, comprising:

a layer of cellular material;

a plurality of channels that fully extend through the layer of cellular material from a top surface to a bottom surface, wherein each of said channels is defined by at least one sidewall of material forming the layer of cellular material where the at least one sidewall surrounds an entire periphery of said channel, the plurality of channels being distributed substantially in a head supporting area, a neck supporting area, a shoulder supporting area, a hip supporting area, an upper thigh supporting area, and a leg supporting area along the top and bottom surfaces of the specialized layer such that the layer of cellular material is configured to support a full length of a reclining body, and wherein the head supporting area, the neck supporting area, the shoulder supporting area, the hip supporting area, the upper thigh supporting area, and the leg supporting area are contained within a perimeter area adjacent to the perimeter of the layer of cellular material; and a gluing area between three and five inches wide, the gluing area located adjacent the perimeter area, being devoid of channels, and surrounding the perimeter area of the layer of cellular material;

wherein the gluing area is configured to enhance lateral creep of the layer of cellular material, thereby increasing fluid like performance of the specialized layer.

10. The layered mattress of claim 9, wherein each channel includes a collapsible sidewall configured to collapse into a channel void.

11. The specialized layer of claim 9, wherein each channel has a circular cross-section.

12. The specialized layer of claim 9, wherein each channel has a cross-sectional diameter of at least ⅝ inch.

13. The specialized layer of claim 9, wherein the perimeter area is glued to the layer of cellular material.

* * * * *